US007547082B2

(12) United States Patent
Lee et al.

(10) Patent No.: US 7,547,082 B2
(45) Date of Patent: Jun. 16, 2009

(54) INK CARTRIDGE INCLUDING A UNIT TO SENSE A REMAINING AMOUNT OF INK

(75) Inventors: Jae-cheol Lee, Hwaseong-si (KR); Dong-kee Jung, Seoul (KR); Seo-hyun Cho, Seongnam-si (KR); Myung-song Jung, Gunpo-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 265 days.

(21) Appl. No.: 11/440,162

(22) Filed: May 25, 2006

(65) Prior Publication Data

US 2007/0008365 A1 Jan. 11, 2007

(30) Foreign Application Priority Data

Jul. 5, 2005 (KR) ..... 10-2005-0060283

(51) Int. Cl.
*B41J 2/195* (2006.01)

(52) U.S. Cl. ..... 347/7

(58) Field of Classification Search ..... 347/7
See application file for complete search history.

(56) References Cited

U.S. PATENT DOCUMENTS 4,604,633 A * 8/1986 Kimura et al. ..... 347/7
6,474,156 B1 * 11/2002 Endo et al. ..... 73/290 V
6,513,891 B2 * 2/2003 Eida ..... 347/7
6,641,240 B2 11/2003 Hsu et al.

FOREIGN PATENT DOCUMENTS

| | | |
|---|---|---|
| EP | 1 125 748 A1 | 8/2001 |
| JP | 2001-121681 | 5/2001 |
| JP | 2002-127443 | 5/2002 |
| KR | 10-2004-0007201 | 1/2004 |

* cited by examiner

*Primary Examiner*—Julian D Huffman
(74) *Attorney, Agent, or Firm*—Stanzione & Kim, LLP

(57) ABSTRACT

An ink cartridge includes a residual ink sensing unit having a simple structure of an upper electrode plate and a lower electrode plate to accurately detect a capacitance between the upper and lower electrode plate. Therefore, data of a remaining amount of ink is reliably measured, there is less possibility that an ink bag is damaged when the residual ink sensing unit is installed in the ink bag, and damage to the ink cartridge and defective printing due to unstable supply of ink and the missing of the time for replacing the ink cartridge are prevented.

15 Claims, 5 Drawing Sheets

INK CARTRIDGE INCLUDING A UNIT TO SENSE A REMAINING AMOUNT OF INK

CROSS-REFERENCE TO RELATED APPLICATIONS

This application claims the priority of Korean Patent Application No. 10-2005-0060283, filed on Jul. 5, 2005, in the Korean Intellectual Property Office, the disclosure of which is incorporated herein in its entirety by reference.

BACKGROUND OF THE INVENTION

1. Field of the Invention

The present general inventive concept relates to an ink cartridge, and more particularly, to an ink cartridge including a residual ink sensing unit to sense an amount of ink remaining in an ink bag.

2. Description of the Related Art

Generally, an inkjet image forming apparatus includes a detachable ink cartridge to form an image by spraying ink to a printing medium. When the ink is exhausted, the ink cartridge is replaced by a new one. The ink cartridge includes a housing that houses the ink cartridge, a nozzle unit that sprays ink to the printing medium, an ink bag that contains ink to be supplied to the nozzle unit and flexibly shrinks according to ink consumption, and a meniscus that forms an ink path from the ink bag to the nozzle unit. When ink is sprayed from the nozzle unit, a negative pressure is generated, and ink contained in the ink bag is continuously provided to the nozzle unit due to the negative pressure.

When the ink contained in the ink bag is exhausted, the value of the negative pressure increases excessively, and consequently the nozzle unit and the meniscus can be damaged. To prevent damage to the nozzle unit and the meniscus and defective printing due to an unstable supply of ink, and to display the time for ink replacement, the ink cartridge includes a residual ink sensing unit.

FIG. 1 is a cross-sectional view illustrating a conventional residual ink sensing unit. Referring to FIG. 1, the residual ink sensing unit includes an ink bag 25, two terminals 24*a* and 24*b*, and an ink outlet 23. The ink bag 25 includes two flexible sidefilms 21 and 22. As an example, each sidefilm 21 and 22 is formed by three layers. An inner layer 19 of the ink bag 25 containing ink is easily attached to an intermediate layer 18, and manufactured with a thin film made of, for example, a polyethylene (PE) material in order to suppress chemical changes of toner. The intermediate layer 18 is formed by an aluminum film in order to protect the toner against the outside air and moisture. An outer layer 17 of the ink bag 25 is made of a material having a higher melting temperature than that of the material of the inner layer 19, and thus the outer layer 17 does not melt when the inner layer 19 is attached to the intermediate layer 18 by means of heat.

Both sidefilms 21 and 22 of the flexible ink bag 25 get closer to each other as the ink is consumed. At this time, a capacitance between the sidefilms 21 and 22 is changed, and a remaining amount of ink is sensed using a change of the capacitance. That is, electrodes 18*a* and 18*b*, formed by removing a part of the outer layer 17 and exposing a part of the intermediate aluminum layer 18, are connected to the terminals 24*a* and 24*b*, respectively, and a voltage value between the terminals 24*a* and 24*b* is measured. If the sidefilms 21 and 22 acting as capacitors and a resistance element (not shown) are appropriately connected to each other to form an RC circuit the change of the capacitance according to the approach of the sidefilms 21 and 22 is measured by a voltage difference.

However, a part of the inner layer 19 of the very thin ink bag 25 may come off. Due to this, insulation of the ink bag 25 is deteriorated, and thus, a functional characteristic of the sidefilms 21 and 22 as the capacitor is lowered, and reliability of data which is measured using the terminals 24*a* and 24*b* is decreased. Moreover, there is a problem in that the sensitivity of the residual ink sensing unit is lowered since the voltage difference is not proportional to the ink consumption.

Meanwhile, a hole is created in the sidefilms 21 and 22 of the ink bag 25 by high heat because the sidefilms 21 and 22 are very thin, and thus an ink storage capacity of the ink bag 25 can be deteriorated. Furthermore, to expose the electrodes 18*a* and 18*b* from the thin sidefilms 21 and 22, chemical materials or specific processes are needed, which make the manufacturing processes complicated.

SUMMARY OF THE INVENTION

The present general inventive concept provides an ink cartridge including a residual ink sensing unit that accurately senses a remaining amount of ink, has high data measurement reliability, does not damage an ink bag, and is manufactured with simple processes.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing an ink cartridge including a housing, an ink bag that contains ink, a first side supported by an inner portion of the housing, and a second side that approaches the first side according to an ink consumption, a residual ink sensing unit that includes a lower electrode plate fixed to the second side, an upper electrode plate opposite to the lower electrode plate and spaced-apart by a distance from the lower electrode plate, the distance being increased to generate a capacitance change according to the ink consumption, and that senses an amount of ink remaining in the ink bag using the capacitance change between the upper and lower electrode plates.

The residual ink sensing unit may further comprise a stopper that stops the movement of the upper electrode plate such that the distance between the upper and lower electrode plates starts to increase when a height of the ink bag reaches a predetermined level according to the ink consumption.

An air gap may be formed between the upper and lower electrode plates.

The ink bag may have a side portion which is Σ-shaped and may include a folded portion.

The residual ink sensing unit may further comprise an elastic member to press the upper electrode plate towards the lower electrode plate.

The foregoing and/or other aspects and utilities of the present general inventive concept may be achieved by providing an ink cartridge apparatus, including a housing, an ink bag disposed within the housing and containing ink, and a residual ink sensing unit having a first electrode formed on the ink bag and a second electrode formed between the first electrode and the housing to sense an amount of ink remaining in the ink bag according to a distance between the first electrode and the second electrode.

The foregoing and/or other aspects and utilities of the present general inventive concept may be achieved by providing an ink cartridge apparatus, including a housing, an ink bag disposed in the housing and containing ink' and a residual ink sensing unit having first and second electrodes having a distance therebetween to be increased according to an ink consumption, and to detect an amount of residual ink according to the increased distance.

The foregoing and/or other aspects and utilities of the present general inventive concept may be achieved by providing an ink cartridge apparatus, including a housing, an ink bag disposed in the housing and containing ink; and a residual ink sensing unit having a first and second electrode and a stopper, and to detect a first state of a first amount of the ink using the first and second electrodes, and a second state of a second amount of ink using the first and second electrodes and the stopper.

The foregoing and/or other aspects and utilities of the present general inventive concept may be achieved by providing method to sense ink remaining in an ink cartridge with a housing and an ink bag, including measuring a capacitance between a first electrode formed on the ink bag and a second electrode formed between the first electrode and the housing where the ink bag has a volume that reduces as ink leaves the cartridge, and increasing the distance between the first electrode and the second electrode at a predetermined volume of ink.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
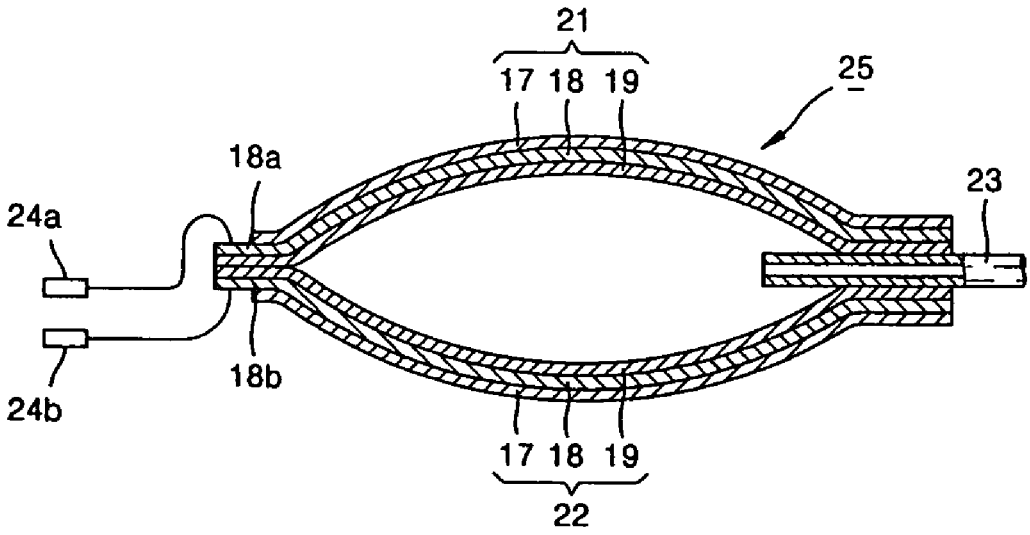
FIG. 1 (PRIOR ART)
FIG. 1 is a cross-sectional view illustrating a conventional residual ink sensing unit.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
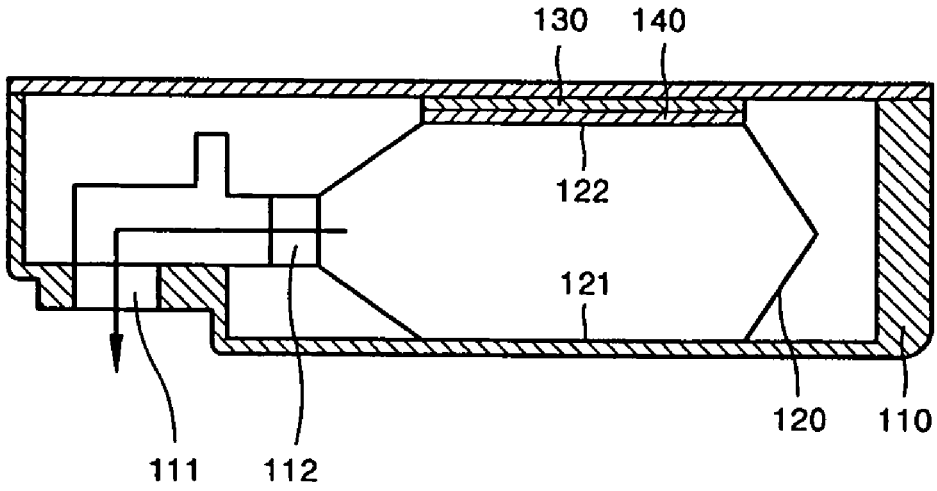
FIG. 2 is a cross-sectional view illustrating an ink cartridge according to an embodiment of the present general inventive concept.

FIG. 2 is a cross-sectional view illustrating an ink cartridge according to an embodiment of the present general inventive concept. Referring to FIG. 2, the ink cartridge includes a housing 110, an ink bag 120, and a residual ink sensing unit. Since a stopper illustrated in FIGS. 5 through 9 is not included in the ink cartridge illustrated in FIG. 2, the movement of an upper electrode plate 130 is not limited. The upper electrode plate 130 is attached to a first inner wall of the housing 110, a lower electrode plate 140 is attached to the ink bag 120, and capacitance changes at the start of ink consumption since a distance between the upper and lower electrode plates 130 and 140 increases according to the ink bag as it shrinks.

The housing 110 forms an external case of the ink cartridge, and includes an ink cartridge outlet 111. The ink cartridge outlet 111 is connected to a nozzle unit of an image forming apparatus to form an image on a printing medium with the ink.

According to the present embodiment, the ink bag 120 contains ink, and includes an ink bag outlet 112 connected to the ink cartridge outlet 111 to draw ink out of the ink cartridge. The ink bag 120 includes a first side 121 and a second side 122. The first side 121 of the ink bag 120 is fixed to a second inner wall of the housing 110. The second side 122 of the ink bag 120 is free, and moves towards the first side 121 fixed to the housing 110 according to ink consumption. The ink bag 120 may be a film formed with a plurality of layers, for example, three layers. According to the present embodiment, an inner layer may be made of a polyethylene material, an intermediate layer may be may be made of an aluminium material, and an outer layer may be made of a polypropylene material.

According to the present embodiment, the residual ink sensing unit includes the upper electrode plate 130 and the lower electrode plate 140. The upper and lower electrode plates 130 and 140 are made of conductive materials. The lower electrode plate 140 is attached to the second side 122 of the ink bag 120, and moves towards the first side 121 of the ink bag 120 according to the ink consumption.

Figure 5:
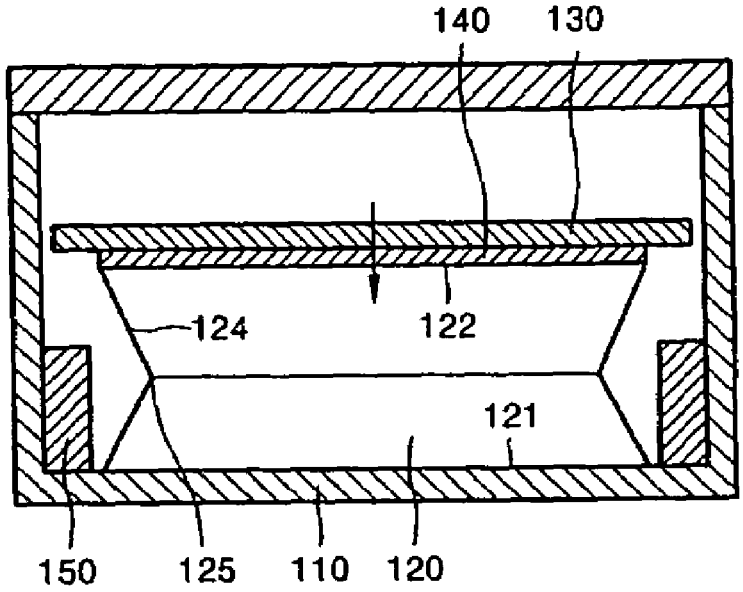
FIGS. 5 and 6 are cross-sectional views illustrating an ink cartridge having a stopper in different states of remaining ink according to an embodiment of the present general inventive concept.
Figure 6:
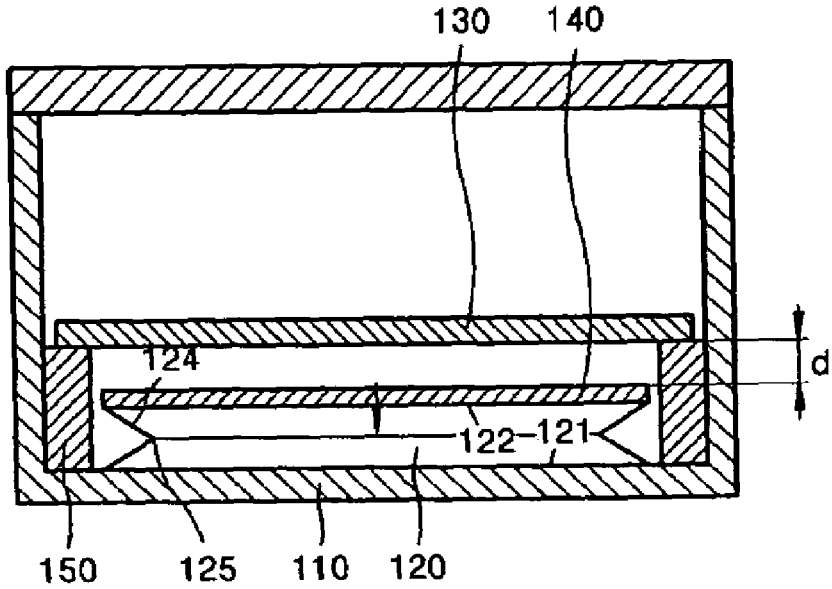
Figure 7:
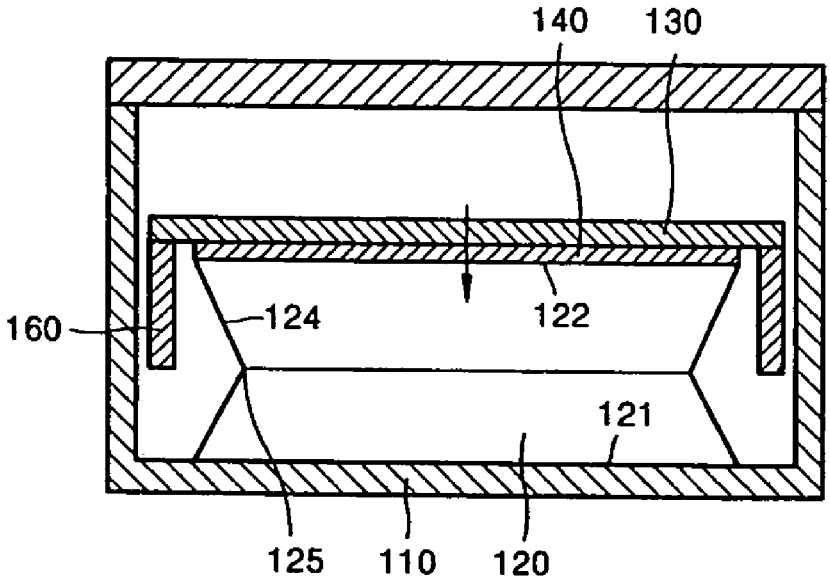
FIGS. 7 and 8 are cross-sectional views illustrating an ink cartridge having a stopper in different states of remaining ink according to an embodiment of the present general inventive concept.

As illustrated in FIGS. 5 and 7, in an initial state where the ink bag 120 is filled with ink, the upper electrode plate 130 contacts the lower electrode plate 140, and the upper and lower plates 130 and 140 being insulated from each other. Further, the upper electrode plate 130 moves while contacting the lower electrode plate 140 when a height of the ink bag 120 that decreases according to ink consumption is greater than a predetermined value. At this time, a capacitance between the upper and lower plates 130 and 140 is maintained at a maximum value. As illustrated in FIGS. 5 through 9, a difference of the height of the ink bag 120 between the initial state where the ink bag 120 is filled with ink and a final state where the ink is completely or almost exhausted is greater than an allowable maximum distance between the upper and lower electrode plates 130 and 140. The capacitance does not change from the initial state where the ink bag 120 is filled with ink to an intermediate state where the height of the ink bag 120 reaches a predetermined level, but the capacitance begins to change when the height of the ink bag 20 is below a predetermined level.

It is possible that the upper electrode plate 140 may be spaced at a predetermined distance from the lower electrode plate 130 in the initial state where the ink bag 120 is filled with ink, and the upper and lower electrode plates 130 and 140 may move together while maintaining the distance therebetween, when the height of the ink bag 120 is greater than the predetermined level.

As illustrated in FIG. 2, the upper electrode plate 140 may be fixed to a top inner wall of the housing 110 in an initial state where the ink bag 120 is filled with ink, and the distance between the upper and lower electrode plates 130 and 140 may begin to change as soon as the ink is consumed.

Figure 3:
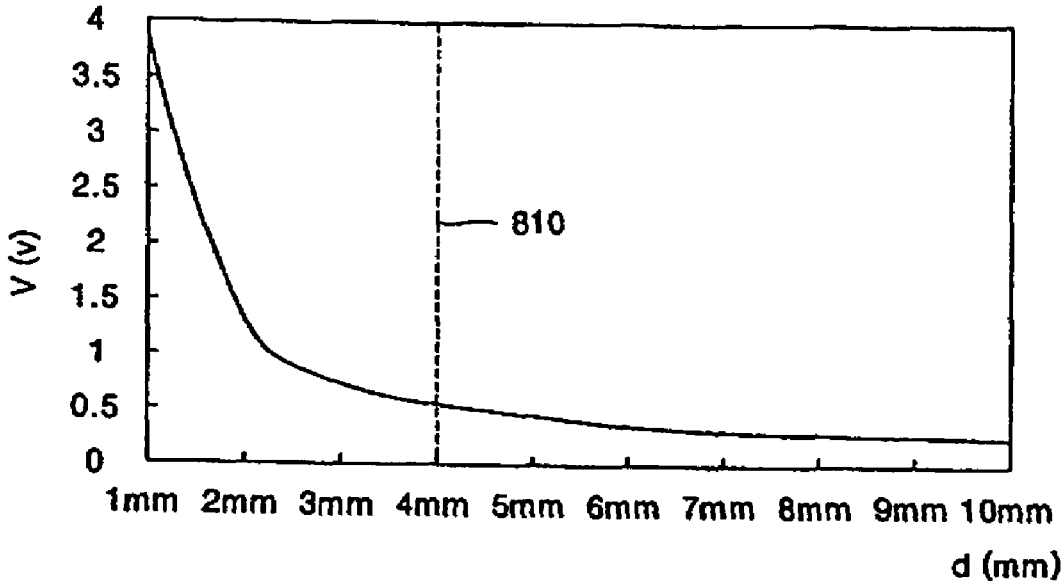
FIG. 3 is a graph illustrating a voltage difference between upper and lower electrode plates according to a distance between the upper and lower electrode plates.

FIG. 3 is a graph illustrating a voltage difference between the upper and lower electrode plates 130 and 140 according to a distance d. Referring to FIG. 3, a horizontal axis d milimeter (mm) represents a distance between the upper and lower electrode plates 130 and 140, and a vertical axis V volt (v) represents the voltage difference between the upper and lower electrode plates 130 and 140 volt (v). Although not illustrated in drawings, the upper and lower electrode plates 130 and 140 act as a capacitor and are connected to a resistance element to form an RC circuit, and capacitance changes according to an increase of the distance d between the upper and lower electrode plate 130 and 140 are measured by a voltage difference between the upper and lower electrode plates 130 and 140. The capacitance between the upper and lower electrode plates 130 and 140 is in proportion to areas of the upper and lower electrode plates 130 and 140 and in inverse proportion to the distance d between the plates 130 and 140. Since the distance between the upper and lower electrode plates 130 and 140 is increased as the ink is consumed, the capacitance is decreased. Due to the decrease of the capacitance, the voltage difference between the upper and lower electrode plates 130 and 140 is reduced in the RC circuit. The voltage difference varies according to a shape of the ink bag 120, shape and material of each of the upper and lower electrode plates 130 and 140, and an insulating material thereof.

According to the present embodiment, when a space between the upper and lower electrode plates 130 and 140 is insulated by air, the slope of the voltage difference is steep in a left range of a portion 810 where the distance d is about 4 mm. Therefore, the maximum distance between the upper and lower electrode plates 130 and 140 may be about 4 mm. In the left range of the portion 810, when the distance d is between 0 mm and 4 mm, the upper and lower electrode plates 130 and 140 may be used as residual ink sensors. When the distance d is between 4 mm and 10 mm, because the capacitance is not sensitively changed, the upper and lower electrode plates 130 and 140 may not be used as residual ink sensors.

Figure 4:
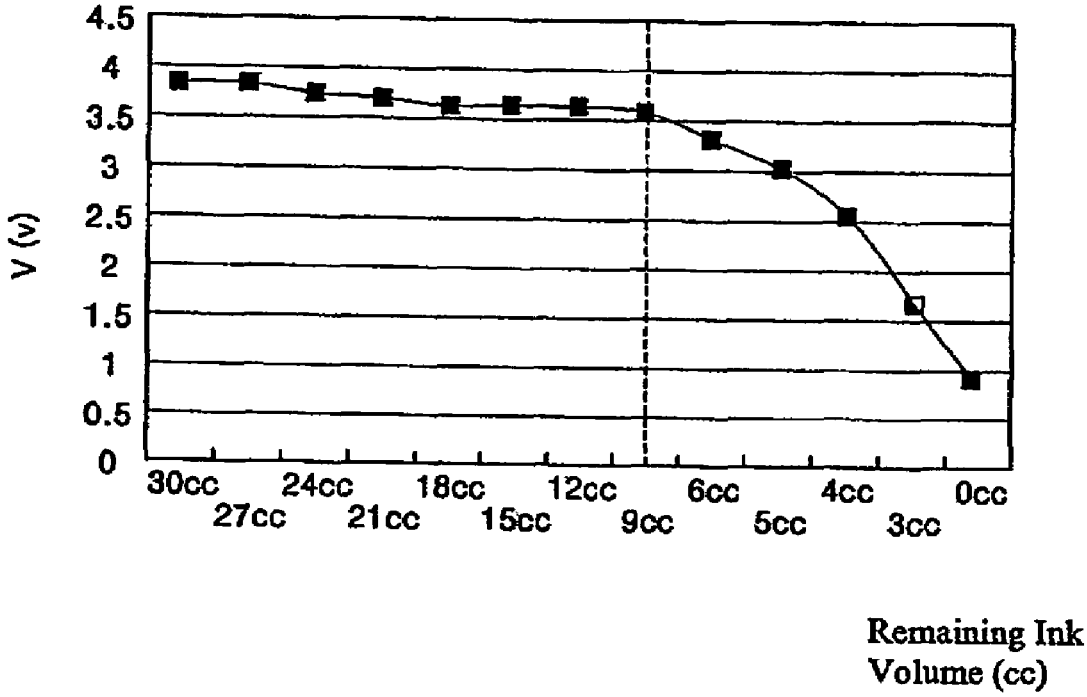
FIG. 4 is a graph illustrating a voltage difference between the upper and lower electrode plates according to a remaining amount of ink.

FIG. 4 is a graph illustrating the voltage difference between the upper and lower electrode plates 130 and 140 according to a remaining amount of ink. The vertical axis represents the voltage difference volt (v) between the upper and lower electrode plates 130 and 140. A horizontal axis represents the amount of ink remaining volume (cc) in the ink bag 120. Since the distance d between the upper and lower electrode plates 130 and 140 is increased according to ink consumption, the capacitance is decreased, and thus the voltage difference between the upper and lower electrode plates 130 and 140 is reduced. When the remaining amount of ink is between 30 cc and 9 cc, the voltage difference between the upper and lower electrode plates 130 and 140 is slightly changed. In this section, the distance d between the upper and lower electrode plates 130 and 140 is 0 and the upper and lower electrode plates 130 and 140 move together as the ink is consumed. When the remaining amount of ink is between 0 and 9 cc, the voltage difference between the upper and lower electrode plates 130 and 140 is sensitively changed. In this section, the distance between the upper and lower electrode plates 130 and 140 is changed in proportion to the remaining amount of ink within 4 mm as illustrated in FIG. 3.

FIGS. 5 and 6 are cross-sectional views illustrating an ink cartridge having a stopper in different states of remaining ink. Referring to FIGS. 5 and 6, stop projections 150 are formed in the housing 110 as the stopper. Since the upper electrode plate 130 moves downward in contact with the lower electrode plate 140 until it meets the stop projections 150, which interrupt the movement of the upper electrode plate 130, the capacitance between the upper and lower electrode plates 130 and 140, which are insulated from each other, is maintained at the maximum value, and the voltage difference between the upper and lower electrode plates 130 and 140 is maintained at the maximum value, for example, approximately 4 V (FIG. 3), and not changed despite the consumption of ink. FIG. 6 illustrates a state where the upper electrode plate 130 meets the stop projections 150 and thus the movement of the upper electrode plate 130 is stopped despite further ink consumption. As the ink is consumed, the lower electrode plate 140 continuously descends, and the distance d between the upper and lower electrode plates 130 and 140 is gradually increased. According to ink consumption, the voltage difference between the upper and lower electrode plates 130 and 140 is continuously reduced.

Figure 8:
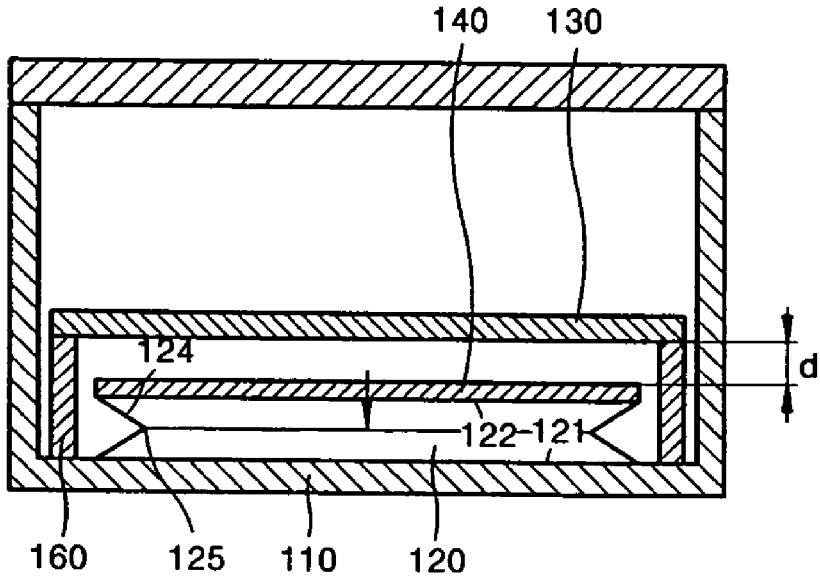

FIGS. 7 and 8 are cross-sectional views illustrating an ink cartridge having a stopper in different states of remaining ink. Referring to FIGS. 7 and 8, stop rods 160 protruding from the upper electrode plate 130 are formed as the stopper. Since the upper electrode plate 130 moves downward in contact with the lower electrode plate 140 until the stop rods 160 meet an inner wall of the housing 110, the capacitance between the upper and lower electrode plates 130 and 140, which are insulated from each other, is maintained at the maximum value, and the voltage difference between the upper and lower electrode plates 130 and 140 is maintained at the maximum value, for example, approximately 4 V (FIG. 3) to and is not changed despite the ink consumption. FIG. 8 illustrates a state where the stop rods 160 of the upper electrode plate 130 contact the inner wall of the housing 110 and the movement of the upper electrode plate 130 is stopped despite the ink consumption. As the ink is consumed, the lower electrode plate 140 continuously descends, and the distance between the upper and lower electrode plates 130 and 140 is gradually increased. The voltage difference between the upper and lower electrode plates 130 and 140 is continuously reduced according to the ink consumption.

Figure 9:
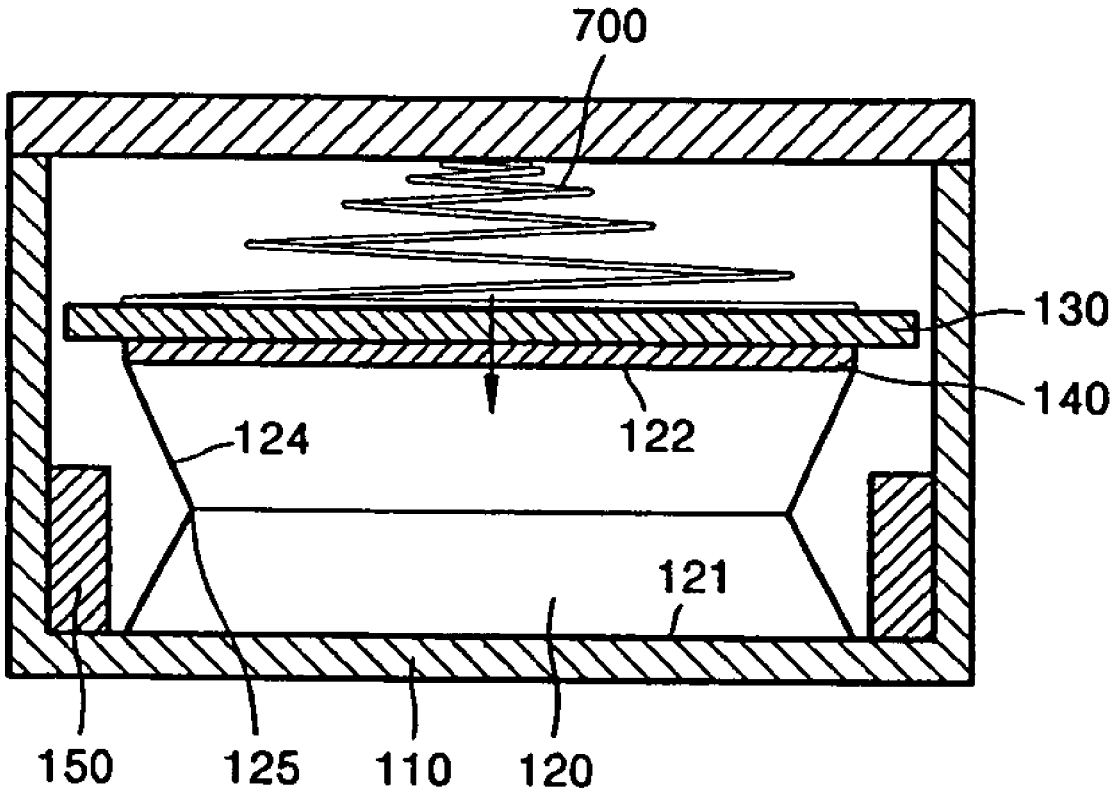
FIG. 9 is a cross-sectional view illustrating an example of an elastic member included in the ink cartridge of FIGS. 2 and 5-8.

FIG. 9 is a cross-sectional view illustrating an ink cartridge having an elastic member 700. Referring to FIG. 9, the elastic member 700 presses the upper electrode plate 130 towards the lower electrode plate 140. The elastic member allows the ink bag 120 to perpendicularly shrink without sloping in any direction. The elastic member 700 may be a conic coil spring. Although not illustrated in drawings, the elastic member may also be a leaf spring, a cylindrical spring, or the like. The conic coil spring 700 may have a coil string diameter of 0.6 to 1.0 mm.

According to the present embodiment, a side portion 124 of the ink bag 120 may form a Σ shape (or an accordion shape) and has a folded portion 125. The Σ shape of the ink bag 120 allows the ink bag 120 to perpendicularly shrink without sloping in any direction.

A look-up table (LUT) may be created to represent a relationship between the voltage difference between the upper and lower electrode plates 130 and 140 and the remaining amount of ink stored in the residual ink sensing unit. The residual ink sensing unit may acquire the voltage difference between the upper and lower electrode plates 130 and 140, sense the remaining amount of ink using the relationship, and further include an additional displaying unit or an alarming unit to display the remaining amount of ink and time for replacing or refilling the ink the ink cartridge unit.

As described above, according to the present general inventive concept, an ink cartridge including a residual ink sensing unit having a simple structure of an upper electrode plate and a lower electrode plate to accurately detect a capacitance between the upper and lower electrode plate. Therefore, reliability of measurement data of a remaining amount of ink is ensured, there is less possibility that an ink bag is damaged when the residual ink sensing unit is installed in the ink bag, and damage to the ink cartridge and defective printing due to unstable supply of ink and the missing of the time for replacing ink are prevented.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An ink cartridge comprising:

a housing;

an ink bag disposed in the housing and comprising:

ink contained therein, a first side supported by an inner portion of the housing, and a second side that approaches the first side according to an ink consumption; and a residual ink sensing unit comprising:

a lower electrode plate fixed to the second side of the ink bag, an upper electrode plate facing the lower electrode plate being movable to have a distance with the lower electrode plate that increases according to the ink consumption, wherein the reduced ink sensing unit senses an amount of ink remaining in the ink bag using a capacitance change between the upper and lower electrode plates.

2. The ink cartridge of claim 1, wherein the residual ink sensing unit further comprises a stopper to stop the movement of the upper electrode plate such that the distance between the upper and lower electrode plates starts to increase when a height of the ink bag reaches a predetermined level according to the ink consumption.

3. The ink cartridge of claim 2, wherein an air gap is formed between the upper and lower electrode plates.

4. The ink cartridge of claim 1, wherein the ink bag has a side portion which is Σ-shaped and includes a folded portion.

5. The ink cartridge of claim 1, wherein the residual ink sensing unit further comprises an elastic member that presses the upper electrode plate towards the lower electrode plate.

6. The ink cartridge of claim 5, wherein the elastic member comprises a conic coil spring.

7. An ink cartridge apparatus, comprising:

a housing;

an ink bag disposed within the housing and containing ink; and a residual ink sensing unit having a first electrode formed on the ink bag and a second electrode formed between the first electrode and the housing to sense an amount of ink remaining in the ink bag according to a distance between the first electrode and the second electrode, wherein the second electrode is movable between the ink bag and the housing.

8. The ink cartridge apparatus of claim 7, wherein:

the ink bag comprises a first portion disposed on a first inside wall of the housing, and a second portion to correspond to a second inside wall; and the first electrode is formed on the second portion of the ink bag.

9. The ink cartridge apparatus of claim 8, wherein the second electrode is disposed between the second portion of the ink bag and the second inside wall of the housing.

10. The ink cartridge apparatus of claim 8, wherein the bag further comprises a middle portion disposed between the first portion and the second portion to be decreased in area according to a shrinkage of the bag.

11. The ink cartridge apparatus of claim 7, wherein the second electrode is a rigid plate.

12. The ink cartridge apparatus of claim 7, wherein the second electrode comprises an end to move to along an inside wall of the housing.

13. The ink cartridge apparatus of claim 7, wherein the first electrode is a rigid plate which is not deformed according to ink consumption of the ink bag.

14. The ink cartridge apparatus of claim 7, further comprising a stopper installed inside the housing to restrict a movement of the second electrode with respect to the first electrode.

15. A method to sense ink remaining in an ink cartridge with a housing and an ink bag, comprising:

measuring a capacitance between a first electrode formed on the ink bag and a second electrode formed between the first electrode and the housing where the ink bag has a volume that reduces as ink leaves the cartridge; and increasing the distance between the first electrode and the second electrode at a predetermined volume of ink, wherein the second electrode is movable between the ink bag and the housing.

* * * * *